US005244227A

United States Patent [19]

Lacroix

[11] Patent Number: 5,244,227

[45] Date of Patent: Sep. 14, 1993

[54] SKI WITH A VARIABLE, CONVEX UPPER SURFACE

[75] Inventor: Jacques Lacroix, Annecy, France

[73] Assignee: Salomon S.A., Annecy Cedex, France

[21] Appl. No.: 733,649

[22] Filed: Jul. 22, 1991

[30] Foreign Application Priority Data

Aug. 6, 1990 [FR] France ..... 9010228

[51] Int. Cl.[5] ..... A63C 5/00

[52] U.S. Cl. ..... 280/609

[58] Field of Search ..... 280/601, 602, 607, 608, 280/609, 610

[56] References Cited

U.S. PATENT DOCUMENTS 5,088,755 2/1992 Jodelet ..... 280/609

FOREIGN PATENT DOCUMENTS 3236016 4/1984 Fed. Rep. of Germany .
2126613 10/1972 France .
2565836 12/1985 France .

*Primary Examiner*—Richard M. Camby
*Attorney, Agent, or Firm*—Sandler Greenblum & Bernstein

[57] ABSTRACT

A ski including an upper surface whose transverse section has a rounded convex shape over the greater portion of the length of the ski. The average radius of the upper surface varies in accordance with the considered longitudinal position of the transverse section along the ski, and is less in the central zone of the ski than in the vicinity of the front and rear end of the ski. This enables the height to be increased in the central portion of the ski and at the same time to reduce the height of the sides of the ski.

26 Claims, 4 Drawing Sheets

SKI WITH A VARIABLE, CONVEX UPPER SURFACE

BACKGROUND OF THE INVENTION

Field of the Invention

The present invention relates to skis used for winter sports, and which are adapted to slide on snow and on ice.

Description of Background and Relevant Information

Skis that are normally used for winter sports include a lower sliding surface that join at two lateral surfaces along two lower edges equipped with metallic running edges, the lateral surfaces joining together at an upper surface. The skis have a width that is relatively small with respect to their length, their front end being curved upwardly to form a spatula. The thickness of the ski is generally greater in the central portion than in the front or rear portions of the ski. In the conventional shapes that are used most often, the width of the lower surface of the ski is smaller in the central portion than in the rear and front portions, the width being at its maximum in the front portion of the ski, i.e., in the vicinity of the spatula.

In known ski structures, the upper surface of the ski is generally a controlled surface, i.e., it is defined by the longitudinal displacement of a transverse straight line parallel to the lower surface of the ski. In other words, the transverse section of the ski is generally a rectangle or a trapezium, the larger opposite sides of the rectangle or of the trapezium being formed by the lower surface and the upper surface of the ski, the smaller opposite sides of the rectangle or of the trapezium being formed by the lateral surfaces of the ski.

The greater thickness of the ski in the central zone confers to the central zone an increased rigidity. This central zone is also adapted to receive bindings that adapt to the boot of the user. Conversely, the front and rear zones of the ski, having a reduced thickness, are more flexible and deform elastically during use of the ski. For the manufacture of a ski with good flexibility in the rear and front zones, it would therefore be necessary to ensure that such front and rear zones have decreased thickness.

The first problem encountered in traditional ski structures is that the central zone of the ski, that has relatively greater thickness in order to confer to it a greater rigidity, results in a fairly substantial increase in the weight of the ski.

The second problem encountered in known ski structures is that the thickness of the ski that is necessary in order for it to obtain adequate mechanical resistance means having lateral ski surfaces that have a relatively substantial height. This relatively substantial height of the lateral surfaces confers a relatively heavy appearance to the ski, and constitutes a substantial lateral support surface, resisting lateral penetration of the ski in the snow, and thus acting as a brake to lateral movements of the ski at a turn, or in a skid.

Another problem encountered in known ski structures is that the central portion of the ski has a relatively reduced width with respect to the end portions of the ski, such that the ski boot adapted to the bindings in the central zone of the ski generally extends beyond both sides of the ski. The ski and the boot being inclined with respect to the ground, the result is that at a turn, the edge of the boot at the inner curve is brought closer to the ground and tends to touch it, a fact that risks braking the forward movement of the skier, and disturbing the effectiveness of the support on the running edges.

SUMMARY OF THE INVENTION

The present invention aims to overcome the aforementioned disadvantages, by means of a new shape for a ski. The shape of the ski varies in accordance with the considered longitudinal portion along the ski, and this variation in shape is such that the ski can be conferred with a real increased height and at the same time the height of the sides or of the lateral surfaces of the ski are reduced, giving the ski the appearance of being less thick, and being advantageous for lateral penetration of the ski in the snow.

The shape of the ski according to the invention is such that the end zones of the ski can be conferred with increased flexibility simultaneously without unduly reducing the height of the sides of the ski in the end zones, such that adequate mechanical resistance is conserved in the portion supporting the lower running edges of the ski.

Simultaneously, the ski structure according to the invention has the effect of elevating the support zone of the boot with respect to the lower sliding surface of the ski, advantageously enabling the disengagement of the sole of the boot with respect to the ground, while taking a turn, and without at the same time increasing either the volume or the weight of the ski compared to traditional structures with rectangular or trapezoidal sections.

In some embodiments, it is moreover possible to benefit from the special external shape of the ski according to the invention, in order to confer to the ski increased mechanical resistance properties during flexion in the central zone, and/or increased mechanical resistance properties in torque along the entire length of the ski, without, at the same time, increasing the volume and weight of the ski with respect to traditional structures of a rectangular or trapezoidal section.

In order to achieve these objectives, as well as others, the ski according to the invention is such that:

in a transverse section, the upper surface has a convex shape over at least the greater portion of the length of the ski;

the convex shape of the tra section of the upper surface is identical to or slightly different from a circle passing by the central portion and the ends of the convex shape, the radius of he circle defining the average radius RM of the transverse section;

the average radius RM of the transverse section of the upper surface varies in accordance with the considered longitudinal position of the transverse section along the ski;

the average radius RM has, in the central zone of the ski, values that are less than the values of the average radius RM in at least one of the front and rear end zones of the ski.

According to a preferred embodiment, the ski comprises, over the greater part of its length, an upper mechanical resistance blade provided in the vicinity of the upper surface of the ski in its median zone close to the median longitudinal vertical plane of the ski, such that the distance between the upper blade and the plane of the neutral horizontal fibers of the ski varies in accordance with the average radius RM of the upper surface of the ski, and the blade is thus at a greater distance from the plane of the neutral fibers in the smaller average radius zones RM and is closer to the plane of the neutral fibers in the greater average radius zones RM.

According to another embodiment, the ski comprises a box like structure, formed of a central core surrounded by a tubular element of mechanical resistance, the tubular element having an external surface close to the external surface of the ski, and substantially parallel to the same, such that the transverse section of the tubular section is rounded in order to follow the convex shape of the upper surface of the ski, conferring the tubular element with improved rigidity in torque.

BRIEF DESCRIPTION OF THE DRAWINGS

Other objectives, characteristics and advantages of the present invention will become more apparent from the description that follows, as well as from the preferred embodiments, that correspond to the annexed drawings, in which.

DETAILED DESCRIPTION OF THE PREFERRED EMBODIMENTS

Figure 1:
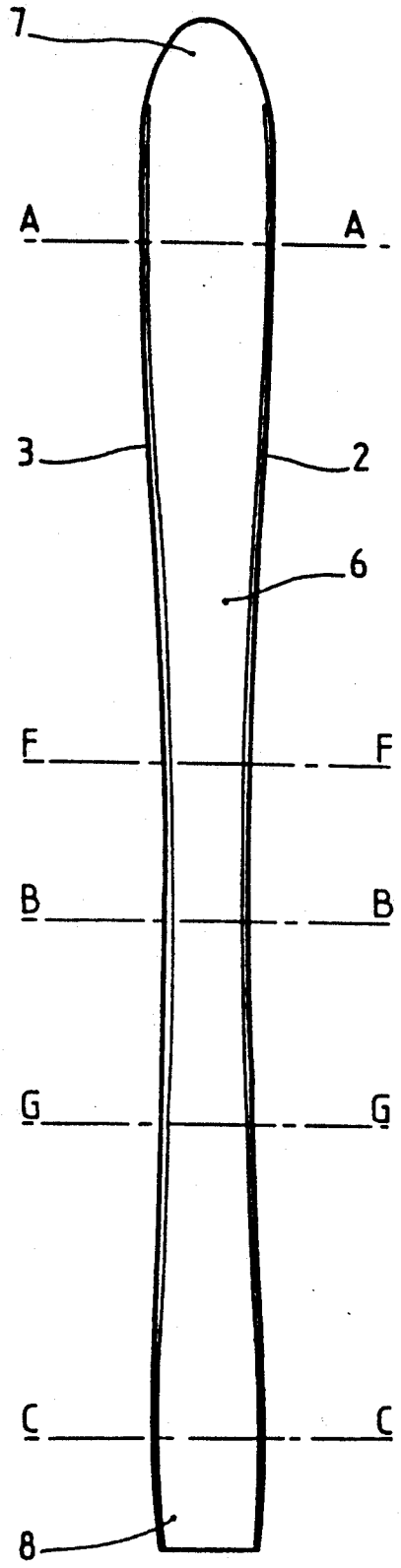
FIG. 1 is an elevational diagrammatic view of the ski, according to the present invention.

As is represented in the drawings, the ski according to the invention has a lower sliding surface 1 joining at two lateral surfaces 2 and 3 along two respective lower edges 4 and 5, equipped with metallic running edges. The lateral surfaces 2 and 3 join at an upper surface 6. The front end of the ski is curved upwardly to form a spatula 7. The rear end of the ski is slightly curved upwardly to form the heel 8. The ski may especially comprise a spatula tip 7 and a heel protector 8, fixed by any means such as clipping, gluing or others.

Figure 3:
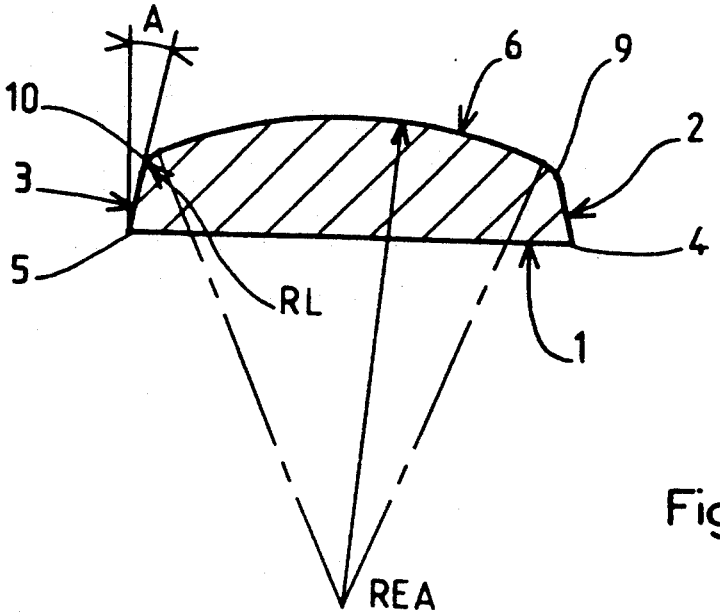
FIGS. 3-5 respectively represent the silhouette of the transverse sections of the ski according to the present invention along planes A—A, B—B, C—C illustrated in FIGS. 1 and 2.
Figure 4:
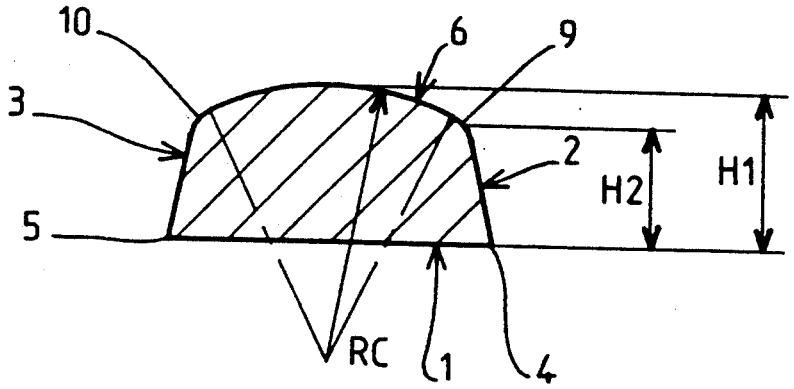
Figure 5:
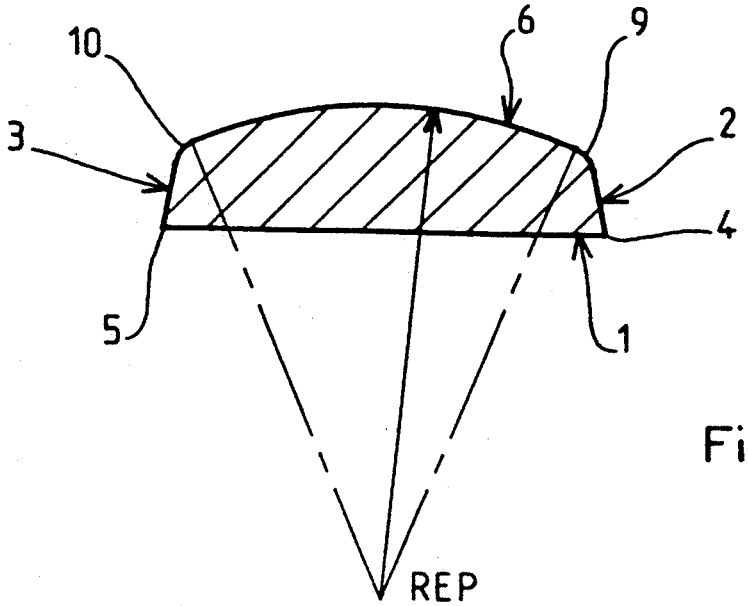
Figure 7:
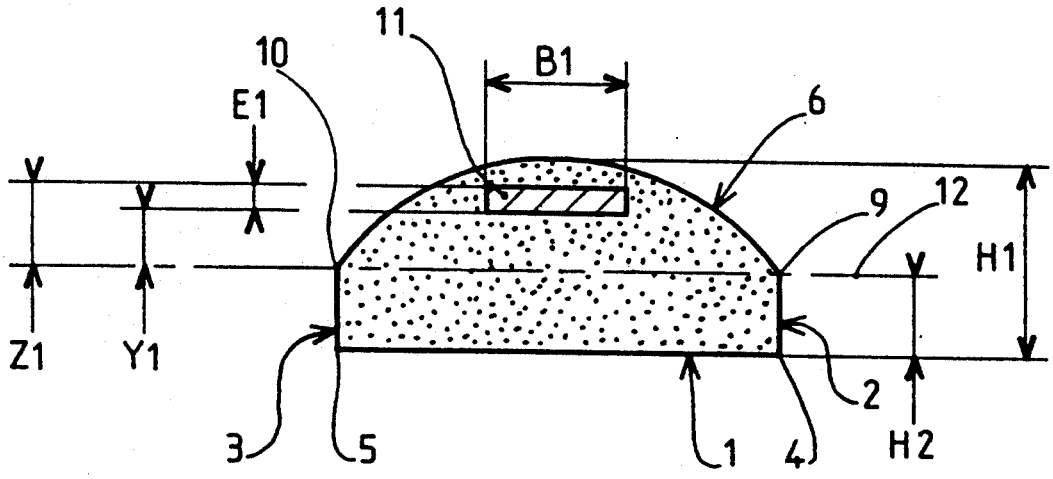
FIG. 7 is a schematic illustration of a ski structure according to the invention, in a transverse section representing an upper mechanical resistance blade.
Figure 8:
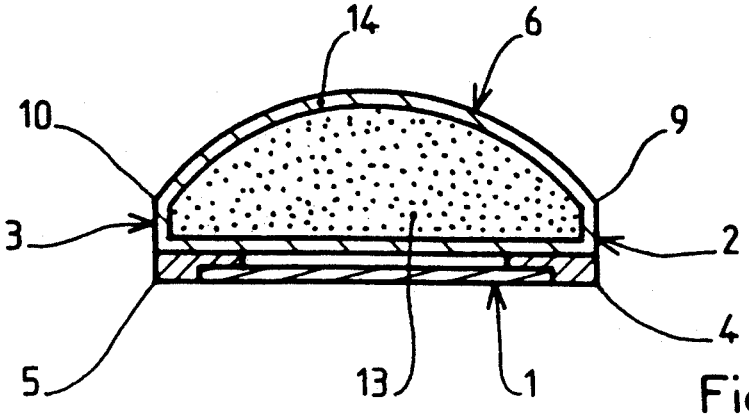
FIG. 8 is a diagrammatic transverse section of the ski according to a preferred embodiment of the invention.

The lateral surfaces 2 and 3 of the ski, in the embodiment represented in FIGS. 3-5, are inclined with respect to the perpendicular at the lower surface 1 of the ski, along an angle A which is substantially constant. In the embodiment represented in FIGS. 7 and 8, the lateral surfaces 2 and 3 of the ski are substantially perpendicular to the lower surface 1. In actuality, in the ski according to the invention, an angle A may be chosen that is close to 0° as is shown in the embodiments of FIGS. 7 and 8, or an angle A may be chosen close to 5° and constant, as is shown in the embodiment of FIGS. 3-5 or an angle A, whose value varies in accordance with the considered longitudinal position along the ski. For example, the angle A may be greater in the vicinity of the ends of the ski, on sections A—A of FIG. 3 or C—C in FIG. 5, than in the central zone on section B—B of FIG. 4.

The lateral surfaces 2 and 3 of the ski join at an upper surface 6 by upper lateral edges 9 and 10 with a rounded transverse section of radius RL. The radius RL advantageously has a value less than 6 millimeters.

The upper surface 6 of the ski according to the invention in a transverse section, over at least the greater portion of the length of the ski, has a convex shape, for example rounded. This convex shape of a transverse section of the upper surface 6 of the ski is an upper line whose central portion constitutes a peak, and whose two ends are inclined at an angle less than approximately 60° with respect to the lower surface of the ski. The upper line has a shape that is identical to, or slightly different from a circle, that is to say, it relatively less distant from a circle passing by the peak, and the ends. The circle that best approximates the convex shape of the transverse section of the upper surface of the ski has a radius, namely, an average radius RM of the transverse section, i.e., an average radius of curvature.

The average radius RM of the transverse section varies in accordance with the considered longitudinal position of the transverse section along the ski. The values of the average radius RM in the central zone of the ski are less than the values of the average radius RM and at least one of the front or rear end zones of the ski.

In the embodiments that have been represented in the drawings, the convex shape of the transverse section of the upper surface of the ski is substantially identical to a circle, that is, its curvature is substantially constant over the entire width of the transverse section. This embodiment confers some regularity to the upper surface.

However, the invention can also be applied to other convex shaped transverse sections of an upper surface. For example, an upper surface can be defined whose shape is more elliptical, with a central portion whose curvature is less than the curvature of the lateral zones of the upper surface. It must however, be avoided that the curvature of the lateral zones of the upper surface be too substantial, because, in this case, one would come closer to the shape of a rectangle, and thus forgo the advantages of the present invention.

One can also envision an upper ski surface, whose transverse section is a polygonal line close to a circle with a radius RM, for example, a line with three segments, with one central segment substantially parallel to the lower surface of the ski and two inclined lateral segments.

At any rate, whether it be an elliptical line, a polygonal line, or any other shape, the convex shape of the transverse section of the upper surface of the ski should not be very different from a circle passing by its central portion and its ends.

In a preferred embodiment represented in FIGS. 3-5, the values of the average radius RM in the central portion of the ski, represented in FIG. 4, are less than the values of the average radius RM in the front end zone of the ski, represented in FIG. 3, and are less than the values of the average radius RM in the rear end zone of the ski, represented in FIG. 5. Also, the maximum average radius REA in the front end zone of the ski is advantageously greater than the maximum average radius REP in the rear end zone of the ski.

Alternatively, in order to come up with other effects, the maximum average radius REA in the front end zone of the ski may be less than the maximum average radius REP in the rear zone of the ski.

Figure 2:
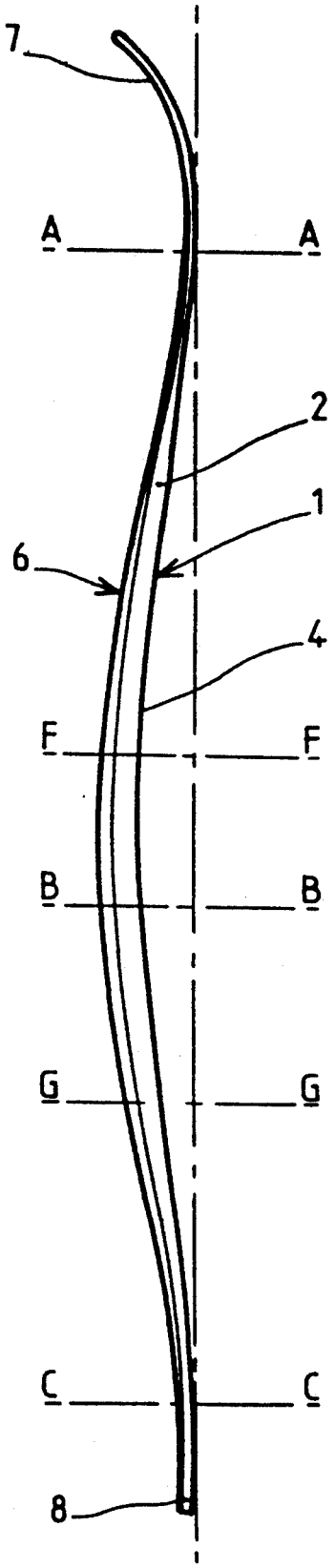
FIG. 2 is a schematic side view of the ski, according to the present invention, the dimensions and deformations in the direction of the thickness of the ski having been deliberately represented on a larger scale than the length of the ski, in order to permit a better understanding of the invention.

The ski bindings, adapted to connect a ski boot on the upper surface 6 of the ski, are generally provided in the central zone of the ski, or just a little behind the middle of the ski, in the zone represented in FIGS. 1 and 2 between the planes of transverse sections F—F and G—G. Accordingly, and especially in accordance with the dimensions of the ski boots of the user, the bindings are fixed on the upper surface of the ski in longitudinal positions that may differ from one case to another, and that are located in a zone whose length is included between 40 and 60 cm approximately. In order to facilitate the positioning of the bindings on the upper surface of the ski, the average radius RM of the transverse section may advantageously conserve a substantially constant value RC in its entire central zone comprised between the planes F—F and G—G. Thus, bindings can be provided whose lower support surface is such that it can be applied with precision on the upper surface of the ski, whatever the longitudinal position in the central zone adapted to receive the bindings.

One can also advantageously provide a curvature to the upper surface of the ski such that:

- the average radius RM in the central zone of the ski is comprised between approximately 70 or 90 mm;
- the maximum average radius REA in the front zone of the ski is comprised between approximately 120 and 155 mm;
- the maximum average radius REP in the rear zone of the ski is comprised between approximately 108 and 138 mm.

Figure 9:
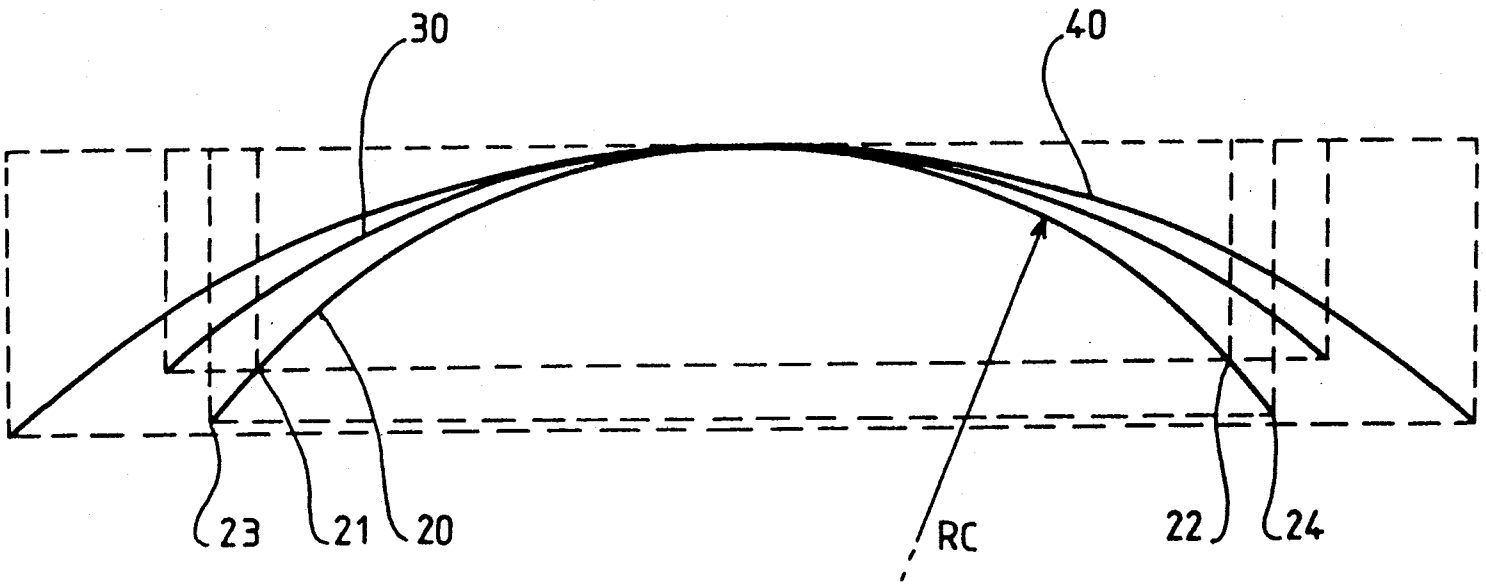
FIG. 9 illustrates the variations and curvature of the upper surface of the ski according to an embodiment of the invention, in the front, central and rear zones of the ski.

FIG. 9 illustrates the variations of the average radius RM or of the curvature, of the transverse section of the upper surface of the ski in accordance with the considered longitudinal position of the transverse section. The curve 20 represents the transverse profile of the upper surface of the ski in the central zone of the ski. In this central zone, the curvature is constant, and, in order to follow the variations and the width of the ski, the curve stops at ends 21 and 22 in the narrowest portion of the ski, and extends up until ends 23 and 24 in the transverse sections of the upper portion of the ski that are closer to the ends of the ski. The curve 30 represents the transverse profile of the upper surface of the ski in the heel zone. The curve 40 represents the transverse profile of an upper surface of the ski in the zone of the spatula.

Preferably, in order to avoid discontinuities in the shape, the average radius RM of the upper surface 6 of the ski varies continuously in accordance with the considered longitudinal position of the transverse section along the ski, from the value RC in the central zone of the ski, to the maximum values REA and REP in the front and rear portions of the ski.

The average radius RM of the upper surface of the ski varies in accordance with the considered longitudinal position of the transverse section, because in order to obtain the desired flexibility, the thickness of the ski must become increasingly smaller the closer one comes to the ends. And, since the ski broadens at the same time, the upper surface 6 must become more and more flattened progressively in order to avoid too great a reduction in the height of the sides in the vicinity of the ends. The result is that it would be advantageous to increase continuously the value of average radius RM as one comes closer to the ends.

Figure 6:
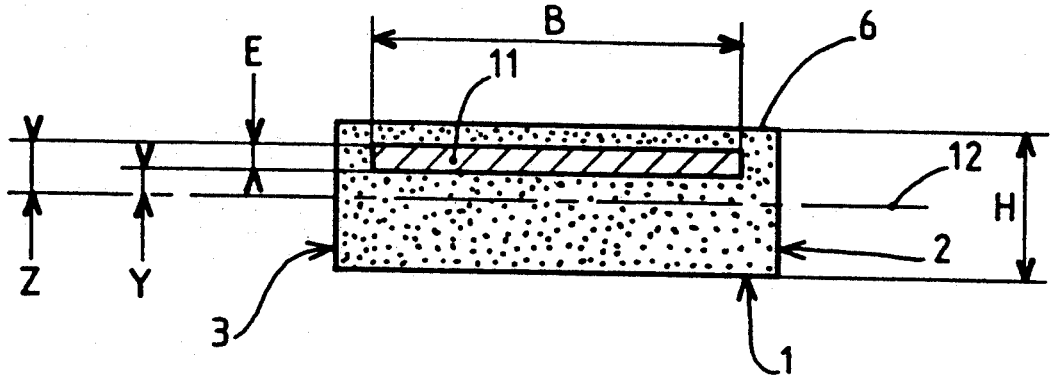
FIG. 6 is a schematic representation of a transverse section of a traditional ski structure with a rectangular section equipped with an upper mechanical resistance blade.

By virtue of the convex rounded shape of the upper surface 6 of the ski, especially in the central zone of the ski represented in FIG. 4, it is understood that a relatively substantial height H1 of the ski and a relatively smaller height H2 of the sides of the ski are obtained, for the same transverse section of the ski with respect to the height H that is constant and obtained in the case of skis with a rectangular section such as represented in FIG. 6. Thus, with respect to a traditional ski with a rectangular section, for a same section and thus a same weight, the ski according to the present invention enables the height H1 to be increased, or distance of the sole of the boot with respect to the ground, and enables simultaneously to reduce the height H2 of the sides or lateral surfaces 2 and 3 of the ski.

According to the invention, one can advantageously benefit from the special convex shape of the ski by adapting it to particular internal structural means of the ski that confer it with increased rigidity.

For example, in FIG. 7 the internal structure of the ski comprises an upper mechanical resistance blade 11, of thickness E1 and width B1 arranged in the vicinity of the upper surface 6 of the ski. The upper mechanical resistance blade 11 confers the ski with adequate rigidity so that it properly resists flexion of the ski in the longitudinal direction. During flexion, the ski reacts like a beam and takes the shape of an arch, the fibers located towards the inside of the arch tending to become shorter, the fibers located towards the outside of the arch tending to become extended, and one can define an average plane 12 containing neutral fibers, that is, fibers whose length is not substantially modified during flexion. The rigidification effect obtained by the upper mechanical resistance blade 11 naturally depends on the thickness E1 and on the width B1 of the blade, as well as on the nature of material used to manufacture the blade, but also depends substantially on the average distance $0.5\times(Y1+Z1)$ between the blade 11 and the plane 12 of the neutral fibers. The rigidity obtained is thus greatly increased when one increases the distance Y1 between the blade 11 and plane 12 of the neutral fibers.

In the case of the present invention, the convex shape of the upper surface 6 of the ski enables the upper mechanical resistance blade 11 to be arranged at an average distance $0.5\times(Y1+Z1)$ that is greater than the average distance $0.5\times(Y+Z)$ possible in a structure with a rectangular section such as represented in FIG. 6. By virtue of the increase in distance, the invention enables substantial reduction in the thickness E1 and width B1, and thus, in the volume and the weight of the upper mechanical resistance blade 11 for an equivalent performance with respect to a traditional rectangular section of a thickness E and of a width B. For example, an upper mechanical resistance blade 11 whose width B1 is less than the width B of the blade necessary in traditional rectangular section ski structures can be provided, for the same thicknesses E1 and E. The result is that the total weight of the ski according to the present invention may be less than the weight of the traditional ski with a rectangular or a trapezoidal section.

In the embodiment in FIG. 8, one can benefit from the special shape of the ski according to the invention in order to increase its rigidity in torque. In this case, the ski includes a box like structure, formed of a central core 13 surrounded by a tubular element 14 of mechanical resistance. The tubular element 14 has an external surface that is close to the external surface of the ski, and substantially parallel to the same, or that can constitute the external surface of the ski itself. In this way, the transverse section of the tubular element is convex, for example, a rounded convex, at least in a portion corresponding to the upper surface 6 of the ski, such that the general section of the tubular element is close to a circular section, conferring the tubular element with increased rigidity in torque.

The instant application is based upon French patent application 90.10228 of Aug. 6, 1990, the disclosure of which is hereby expressly incorporated by reference thereto, in its entirety, and the priority of which is hereby claimed.

The present invention is not limited to the embodiments that have been explicitly described therein, and may include other variants, and generalization contained in the claims that follow.

What is claimed is:

1. A ski comprising:

a lower sliding surface joining two lateral surfaces along two lower edges, the lateral surfaces joining an upper surface;

the upper surface, in a transverse section, has a convex shape over at least the greater portion of the length of the ski;

said convex shape of the transverse section of the upper surface is identical or slightly different from a circle passing by the central portion and the ends of the convex shape, the radius of the circle defining the average radius of the transverse section;

the average radius of the transverse section of the upper surface varies in accordance with the considered longitudinal position of the transverse section along the ski; and the average radius in the central zone of the ski has values that are less than the values of the average radius in at least one of the front and rear end zones of the ski.

2. The ski according to claim 1, wherein the average radius in the central zone of the ski is substantially equal to the constant value in that portion of the central zone adapted to receive the bindings.

3. The ski according to claim 2, wherein that portion of the central zone in which the average radius is substantially equal to the constant value has a length that is generally comprised between 40 and 60 cm.

4. The ski according to claim 1, wherein the values of the average radius in the central zone are less than the values of the average radius in the front end zone of the ski, and to the values of the average radius in the rear end zone of the ski.

5. The ski according to claim 4, wherein the maximum average radius in the front end zone of the ski is greater than the maximum average radius in the rear end zone of the ski.

6. The ski according to claim 4, wherein the maximum average radius in the front end zone of the ski is less than the maximum average radius in the rear end zone of the ski.

7. The ski according to claim 1, wherein the values of the average radius in the central zone of the ski is generally comprised between 70–90 mm.

8. The ski according to claim 1, wherein the maximum value of the average radius in the front zone of the ski is generally comprised between 120 and 155 mm.

9. The ski according to claim 1, wherein the maximum value of the average radius in the rear zone of the ski is generally comprised between 108 and 138 mm.

10. A ski comprising:

a lower sliding surface joining two lateral surfaces along two lower edges, the lateral surfaces joining an upper surface;

the upper surface, in a transverse section, has a convex shape over at least the greater portion of the length of the ski;

said convex shape of the transverse section of the upper surface is identical or slightly different from a circle passing by the central portion and the ends of the convex shape, the radius of the circle defining the average radius of the transverse section;

the average radius of the transverse section of the upper surface varies in accordance with the considered longitudinal portion of the transverse section along the ski;

the average radius of the central zone of the ski has values that are less than the values of the average radius in at least one of the front and the rear end zones of the ski; and the average radius of the upper surface of the ski varies continuously in accordance with the considered longitudinal position of the transverse section along the ski.

11. The ski according to claim 1, wherein the rounded upper surface is joined at the lateral surfaces by upper lateral edges with a rounded transverse section of a radius less than about 6 mm.

12. The ski according to claim 1, wherein it comprises, over the greater portion of its length, an upper mechanical resistance blade provided in the vicinity of the upper surface of the ski in its median zone close to the median longitudinal vertical plane of the ski, such that the distance between said upper blade and the plane of the neutral horizontal fibers of the ski varies in accordance with the average radius of the upper surface of the ski, and said blade is at a distance from the plane of the neutral fibers in the smaller average radius zones and is closer to the plane of the neutral fibers in the zones where the average radius is greater.

13. The ski according to claim 1, wherein it comprises of a box type structure, formed of a central core surrounded by a tubular element of mechanical resistance, the tubular element having an external surface close to the external surface of the ski, and substantially parallel to the same, such that the transverse section of the tubular element is rounded in order to follow the convex shape of the upper surface of the ski, conferring improved rigidity in torque to the tubular element.

14. A ski comprising:

a predetermined length;

a front end zone;

a rear end zone;

a central zone extending from said front end zone to said rear end zone;

an upper surface having a convex shape, in transverse cross section, along a majority of said predetermined length and extending at least along portions of each of said rear end zone, said front end zone and said central zone;

at least a portion of said convex shape having an average radius of curvature, said average radius of curvature varying as a function of distance along at least a portion of said majority of said predetermined length, said average radius of curvature in said central zone of said ski being less than said average radius of curvature in at least one of said front end zone and said rear end zone of said ski.

15. The ski according to claim 14, said average radius of curvature is substantially constant along a portion of said central zone of said ski to accommodate positioning of bindings in said portion of said central zone.

16. The ski according to claim 15, said portion of said central zone of said ski having a length between approximately 40 and 60 centimeters.

17. The ski according to claim 14, said average radius of curvature in said central zone of said ski being less than said average radius of curvature in each of said front end zone and said rear end zone.

18. The ski according to claim 17, a maximum of said average radius of curvature in said front end zone of said ski being greater than a maximum of said average radius of curvature in said rear end zone of said ski.

19. The ski according to claim 17, a maximum of said average radius of curvature in said front end zone of said ski being less than a maximum of said average radius of curvature in said rear end zone of said ski.

20. The ski according to claim 14, said average radius of curvature in said central zone of said ski being approximately between 70 and 90 millimeters.

21. The ski according to claim 14, said average radius of curvature in said front end zone of said ski having a maximum value of approximately between 120 and 155 millimeters.

22. The ski according to claim 14, said average radius of curvature in said rear end zone of said ski having a maximum value of approximately between 108 and 138 millimeters.

23. A ski comprising:

a predetermined length;

a front end zone;

a rear end zone;

a central zone extending from said front end zone to said rear end zone;

an upper surface having a convex shape, in transverse cross section, along a majority of said predetermined length and extending at least along portions of each of said rear end zone, said front end zone and said central zone;

at least a portion of said convex shape having an average radius of curvature, said average radius of curvature varying as a function of distance along at least a portion of said majority of said predetermined length, said average radius of curvature in said central zone of said ski being less than said average radius of curvature in at least one of said front end zone and said rear end zone of said ski; and said average radius of curvature varying continuously as a function of distance along at least a portion of said majority of said predetermined length.

24. The ski according to claim 14, further comprising a pair of lateral surfaces joining said upper surface on opposite lateral sides of said upper surface, and a lower sliding surface extending between said pair of lateral surfaces.

25. The ski according to claim 14, further comprising an upper resistance element within said ski, spaced below said upper surface.

26. The ski according to claim 14, said ski having an outer periphery that includes said upper surface, said outer periphery formed by a tubular element to confer to said ski a box type structure.

* * * * *